United States Patent [19]

Kawashima et al.

[11] Patent Number: 4,822,184

[45] Date of Patent: Apr. 18, 1989

[54] PAPER FEEDER FOR A PRINTER

[76] Inventors: Norio Kawashima, 17-17 Hirado 2chome, Totsuka-ku; Hidemi Haga, Mori-so, 19-9 Nakahama-cho, Isogo-ku, both of Yokohama-shi, Kanagawa-ken, Japan

[21] Appl. No.: 171,133

[22] Filed: Mar. 17, 1988

Related U.S. Application Data

[63] Continuation of Ser. No. 915,155, Oct. 2, 1986, abandoned.

[30] Foreign Application Priority Data

Oct. 3, 1985 [JP] Japan ..... 60-220966

[51] Int. Cl.[4] ..... B41J 11/30; B41J 11/32

[52] U.S. Cl. ..... 400/616.1; 400/616.2

[58] Field of Search ..... 400/578, 611, 612, 616.1, 400/616.2, 616.3, 616, 622, 642; 226/74, 75, 86

[56] References Cited

U.S. PATENT DOCUMENTS

| | | | |
|---|---|---|---|
| 2,400,226 | 5/1946 | Euth | 400/616 X |
| 4,402,623 | 9/1983 | Biche et al. | 400/616.1 X |
| 4,571,103 | 2/1986 | Takeo et al. | 400/616.1 X |

FOREIGN PATENT DOCUMENTS

| | | | |
|---|---|---|---|
| 112778 | 7/1983 | Japan | 400/616.1 |
| 52375 | 3/1985 | Japan | 400/616.1 |
| 52376 | 3/1985 | Japan | 400/616.1 |

*Primary Examiner*—Charles Pearson

*Attorney, Agent, or Firm*—Albert L. Jeffers; Anthony Niewyk

[57] ABSTRACT

A paper feeder for a printer having a platen and a tractor feeder which is provided with a pin belt having pins projecting from upper and lower surface of the tractor feeder, and the tractor feeder can be selectively placed either one of a first position in which the paper feeding plane of the paper feeding pins of the lower surface of the tractor feeder aligns with a tangential direction of a lower part of the platen and a second position in which the paper feeding plane of the paper feeding pins of the upper surface is aligned with a tangential direction of an upper part of the platen. Preferably, the tractor feeder can be held at a third position which is intermediate between the first and the second position and a middle plane between the upper and the lower paper feeding plane align with a radial line of the platen. Thus, depending on the position of the tractor feeder, the printing paper can be pulled from the platen, pushed toward the platen or pushed and pulled towards and away from the platen as desired.

6 Claims, 3 Drawing Sheets

PAPER FEEDER FOR A PRINTER

This is a continuation of application Ser. No. 915,155, filed Oct. 2, 1986, now abandoned.

TECHNICAL FIELD

The present invention relates to a paper feeder for a printer and in particular to a paper feeder which is commonly called a tractor feeder for feeding continuous paper having perforations along side edges thereof by driving pins that are engaged to these perforations.

BACKGROUND OF THE INVENTION

In a conventional tractor feeder which typically comprises a pair of tractor feeder units, pins projecting from a pin belt which is passed along the upper surface of each of the tractor feeder units are engaged to the perforations provided along side edges of the printing paper so as to pull the paper, as the pin belt is driven along the upper surface of the tractor feeder unit, after the paper is passed around a platen. However, there is a demand for reversing the paper feeding direction, for example for graphic printing purposes. Additionally, depending on the applications, it is desirable, instead of pulling the printing paper from the platen, to push the printing paper by the means of the pins, which are engaged with the perforations of the printing paper, towards the platen, and, alternatively, to both push and pull the printing paper towards and away from the platen by using the upper and the lower surfaces of the tractor units. A conventional paper feeder for a printer is capable of only one of the above mentioned three modes of paper feeding and it has been necessary to change the paper feeder when the mode of paper feeding is to be changed.

BRIEF SUMMARY OF THE INVENTION

In view of such inconveniences of the prior art, a primary object of the present invention is to provide a paper feeder for a printer which can be readily adapted for at least two of the above mentioned three modes of paper feeding.

According to the present invention, such an object is accomplished by providing a paper feeder for a printer having a platen and a tractor feeder which is provided with paper feeding means on its upper and lower surface, characterized in that: the tractor feeder can be selectively placed in either one of at least two positions, whereby in a first position the paper feeding plane of the paper feeding means of the lower surface of the tractor feeder aligns with a tangential direction of a lower part of the platen, in a second position the paper feeding plane of the paper feeding means of the upper surface is aligned with a tangential direction of an upper part of the platen, and in a third position a middle plane between the paper feeding planes of the upper and the lower surface of the paper feeding means is substantially aligned with a radial line of the platen.

Thus, simply by changing the position of the tractor feeder, the mode of paper feeding can be readily changed. Furthermore, ease of setting up printing paper on the paper feeder is no way impaired by this feature.

BRIEF DESCRIPTION OF THE DRAWINGS

The present invention will now be shown and described in the following in terms of a concrete embodiment thereof with reference to the appended drawings, in which.

DETAILED DESCRIPTION OF THE PREFERRED EMBODIMENT

Figure 1:
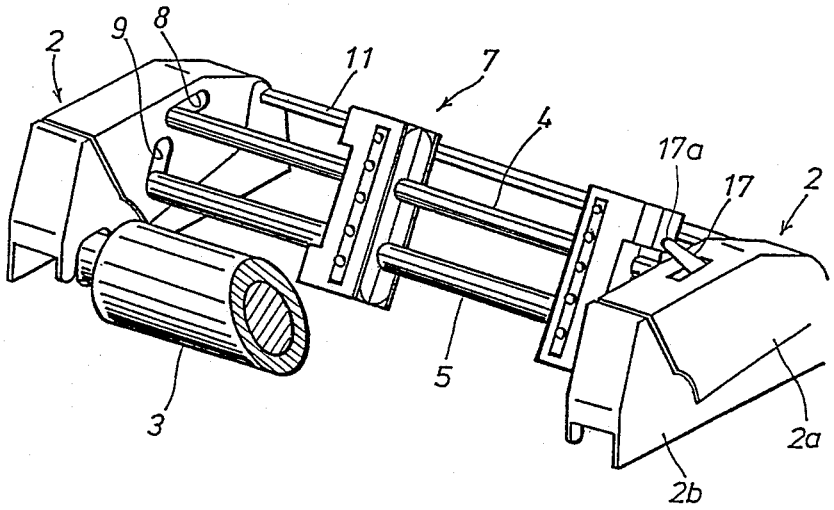
FIG. 1 is a partly broken away perspective view of an embodiment of the paper feeder of the present invention.

As shown in FIG. 1, a columnar platen 3 and a pair of lateral shafts 4 and 5 extend between a pair of frames 2 provided on either side end of the printer. A pair of tractor feeder units 7 are fitted over the lateral shafts 4 and 5 so as to be adjustable of their positions along the lateral shafts 4 and 5. The rear parts of the frames 2 are connected by a pivot shaft 11.

Figure 6:
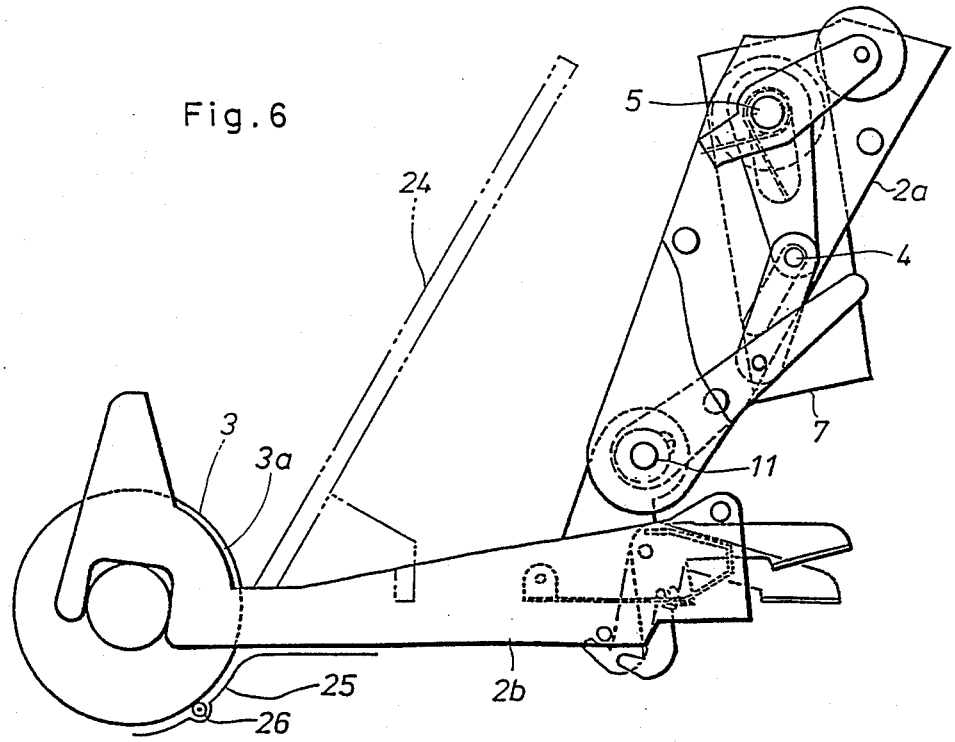
FIGS. 3 to 6 are simplified schematic side views of the paper feeder when it is adapted for different modes of paper feeding.
Figure 2:
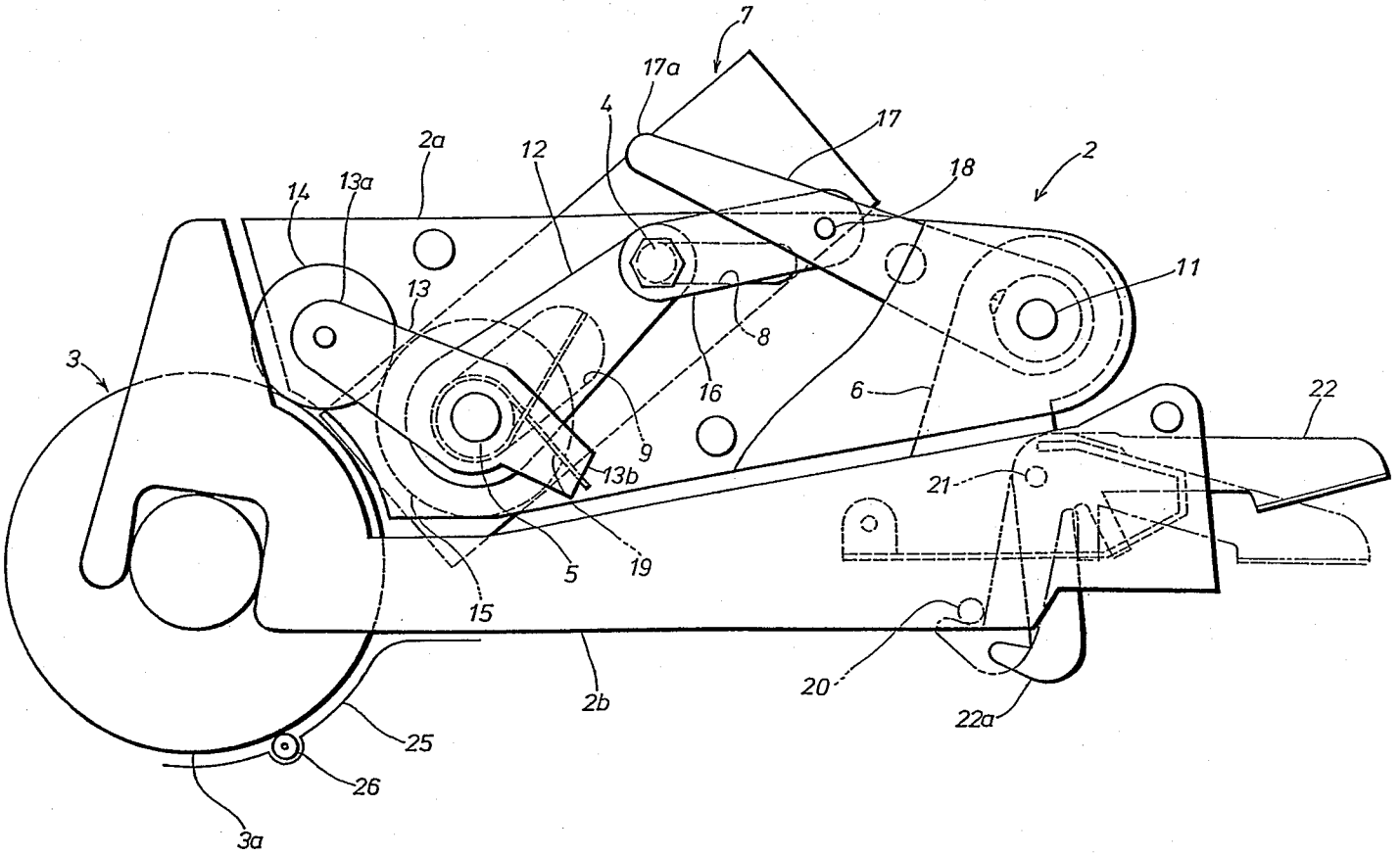
FIG. 2 is a schematic side view of the paper feeder of FIG. 1 illustrating the mechanism thereof in greater detail.

As best shown in FIG. 2, each of the frames 2 consists of an upper frame **2*a* and a lower frame 2*b*, and the upper frames 2*a* are pivoted, at their rear ends, to the lower frames 2*b* by way of a pair of brackets 6 which project from the rear ends of the lower frames 2*b* and the pivot shaft 11 passed therethrough, so as to be backwardly rotatable as shown in FIG. 6 about the pivot shaft 11**.

The internal structures of the frames 2 are identical to each other except for certain slight differences. Therefore, in the following description, only one of the two frames 2 is described and the slight differences are described hereinafter.

The ends of the lateral shafts 4 and 5 are received in a slot 8 which is substantially horizontal and another slot 9 which is inclinded upwards towards the rear, respectively, and both of the slots 8 and 9 are formed in the side plate of the upper frame **2*a*. The end of the lateral shaft 4 received in the frame 2*a* is fixedly attached to a connecting plate 12, and the other end of the connecting plate 12 rotatably supports the end of the other lateral shaft 5 received in the frame 2*a*. The same end of the lateral shaft 5 is rotatably supported by an intermediate part of a link 13. One end 13*a* of the link 13 rotatably supports a spur gear 14 while the other end 13*b* of the link 13 is engaged to an end of a torsion coil spring 19 which biases the link 13 in counter clockwise direction in the sense of FIG. 2**.

The gear 14 is meshed with a gear 15 fixedly attached to the end of the lateral shaft 5 received in the frame **2*a* as well as with a gear 3*a* which is fixedly attached to an end of the platen 3. Thus, when the platen 3 is rotatively driven by a drive means which is not shown in the drawings, the torque thereof is transmitted to the lateral shaft 5 by way of the gears 3*a*, 14 and 15** and drives a pair of pulleys and tractor pin belts passed around the pulleys (which are not shown in the drawings) for effecting the feeding of printing paper by engagement of the pins of the tractor pin belts with the perforations provided in the lateral edges of the printing paper. In this case, the pins of the tractor pin belts projects from both the upper and the lower surfaces of the tractor feeder units.

The end of the lateral shaft 4 received in the frame **2*a* is pivotably connected to a link 16 and the other end of the link 16 is connected, by way of a pin 18, to an intermediate point of an arm 17 which is pivotably supported by the pivot shaft 11. The free end 17***a* of the arm 17 projects out from a slot provided in the upper surface of one of the frames 2*a*, but the arm 17 in the other frame 2*a* lacks such a free end as shown in FIG. 1 and the arm 17 of the other frame extend only between the pin 18 and the pivot shaft 11.

Thus, in the other frame 2, the corresponding ends of the lateral shafts 4 and 5 are simply received in slots which are identical to the slots 8 and 9 and are mutually connected by a connecting plate which is identical to the connecting plate 12. Thus, these ends of the lateral shafts 4 and 5 received in this frame 2 follow the motion of the other ends of the lateral shafts 4 and 5 received in the other frame 2.

A lever 22 is pivoted to the rear part of the lower frame 2*b*, and the frame 2 can be removed from the main body of the printer by disengaging an engagement portion 22*a* provided on one end of the lever 22 from an engagement pin 20 provided on the side of the printer main body 30. The lower circumferential surface of the platen 3 is in contact with a roller 26 which is rotatably supported by a shaft which is parallel to the platen 3 and a paper guide 25 consisting of an arcuately curved plate is provided adjacent thereto.

Now the action of the present embodiment is described in the following with reference to FIGS. 3 to 6.

Figure 3:
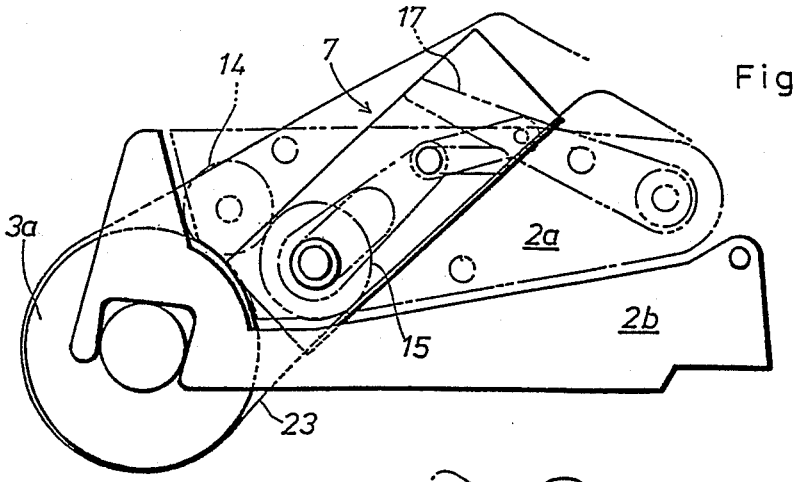

In the state shown in FIG. 3 which is identical to FIG. 2 except for that FIG. 3 is more simplified than FIG. 2, the lower surfaces of the tractor feeder units 7 are aligned with a tangential direction of a lower part of the platen 3 and the printing paper 23 is pushed by the lower surfaces of the tractor feeder units 7 towards the platen 3 which is also driven by a drive means which is not shown in the drawings.

Figure 4:
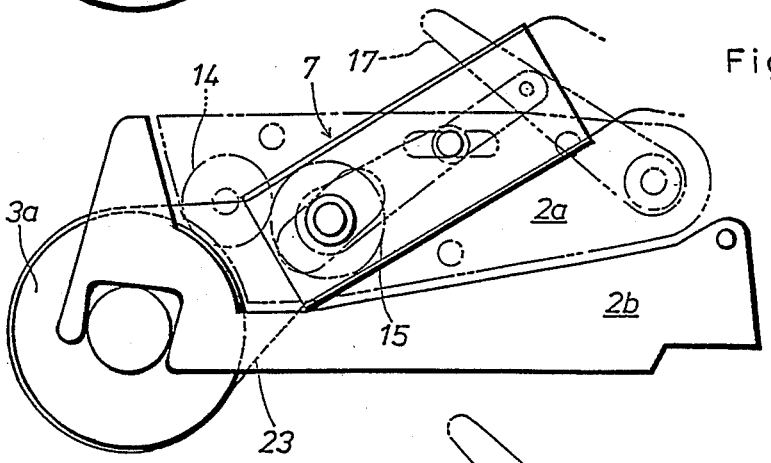

When the free end of the arm 17 projecting from the upper part of the upper frame 2*a* is pulled up into the position shown in FIG. 4, the lateral shaft 4 moves in the slots 8 toward the rear while the lateral shaft 5 moves in the upward and rearward direction guided by the inclined slots 9, and the tractor feeder units 7 themselves align with a radial line of the platen 3. In this state, the perforations of the printing paper 23 are engaged to the pins of the upper and the lower surfaces of the tractor feeder units 7, and the printing paper is both pulled and pushed by the tractor feeder units 7 away from and towards the platen 3. Thus, the printing paper is positively driven in both directions by the tractor feeder units 7 and passed around the platen 3.

Figure 5:
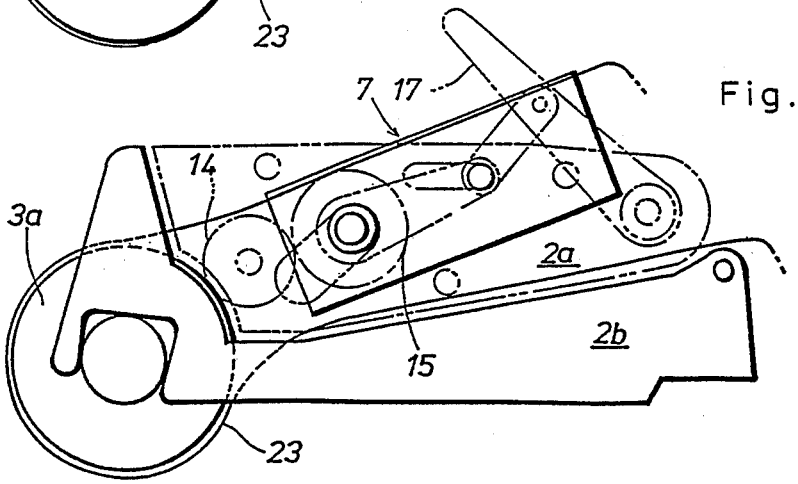

When the arm 17 is further pulled up into the position shown in FIG. 5, the upper surfaces of the tractor feeder units 7 align with a tangential direction of an upper part of the platen 3 an only the pins projecting from the upper surfaces of the tractor feeder units 7 engage with the perforations of the printing paper 23. Therefore, the printing paper 23 which has passed through the surface of the platen 3 is pulled away from the platen 3 by the tractor feeder units 7.

The arm 17 can be retained at the three positions by a detect mechanism which is not shown in the drawings.

FIG. 6 shows the state of the paper feeder of the present embodiment when cut sheet printing paper is to be handled. In this case, the upper frame 2*a* is thrown backward about the pivot shaft 11 and a paper tray 24 is placed along a tangential direction of the platen as required. Therefore, when a sheet of cut sheet paper is placed on the paper tray 24, the lower edge of the paper passes through the nip between the platen 3 and the roller 26 and is passed around the platen 3 in a usual manner. In this case, since the tractor feeder units 7 and the upper frame 2*a* are rotated backward well out of way for handling cut sheet printing paper, there is no need to actually remove the tractor feeder units 7. When only the lower surfaces of the tractor feeder units 7 are used, the continuous paper may be kept on the tractor feeder units 7 while cut sheet printing paper is being used for printing.

What we claim is:

1. A paper feeder for a printer comprising:

a frame;

a platen mounted on said frame and having a peripheral paper guiding surface for guiding a moving continuous sheet of paper which is wrapped around at least a portion of said paper feeding surface whereby said sheet forms first and second runs of paper which respectively move toward and away from said platen;

a tractor feeder supported on said frame between first and second runs of a moving sheet of paper, said tracor feeder having first and second surface and first and second paper feeders respectively located on said first and second surfaces, said tractor feeder being adjustably supported for selective positioning into first and second paper feeding positions; and means for selectively placing said tractor feeder into said first position wherein said first surface is tangential to said paper guiding surface, whereby said first paper feeder feeds paper toward said platen and into said second position wherein said second surface is tangential to said paper guiding surface whereby said second paper feeder feeds paper away from said platen.

2. A paper feeder for a printer as defined in claim 1, including means for positioning the tractor feeder into a third position which is intermediate the first and the second positions and in which the respective first and second paper feeders of the tractor feeder respectively feed paper toward and away from the platen.

3. A paper feeder for a printer as defined in claim 2, wherein said means for positioning comprises a pair of movable shafts for adjustably supporting said tractor feeder, whereby when the tractor feeder is held at the first position, an intermediate plane located between the planes of the first surface and the second surface of the tractor feeder substantially coincides with a radial line of the platen and said first and second paper feeders respectively feed paper toward and away from said platen.

4. A paper feeder for a printer having a platen and a tractor feeder operatively associated with said platen and having first and second paper feeding means on both first and second surfaces of said tractor feeder for respectively feeding paper toward and away from said platen, said tractor feeder having first and second positions and being located between first and second runs of printing paper in both said first and second positions;

means for selectively placing the tractor feeder in either the first position in which the paper feeding plane of the paper feeding means on the first surface of the tractor feeder is tangential to the platen or the second position in which an intermediate plane located between paper feeding planes of the first surface and the second surface of the tractor feeder substantially coincides with a radial line of the platen, whereby both the first and the second paper feeding means of the tractor feeder are engaged with first and second runs of the printing paper which are being respectively fed into and out of the platen.

5. A paper feeder for a printer having a platen and a tractor feeder operatively associated with said platen and having first and second paper feeding means respectively on both first and second surfaces of said tractor feeder for respectively feeding paper toward and away from said platen, said tractor feeder having first and second positions and being located between first and second runs of printing paper in both said first and second positions;

means for selectively placing the tractor feeder in either the first position in which the paper feeding plane of the first paper feeding means on the first surface of the tractor feeder is tangential to a first part of the platen or the second position in which an intermediate plane located between paper feeding planes of the first surface and the second surface of the paper feeding means substantially coincides with a radial line of the platen, whereby both the first and the second paper feeding means of the tractor feeder are engaged with first and second runs of the printing paper which are being respectively fed toward and away from the platen.

6. A paper feeder for a printer as defined in any one of claims 2, 4, 5 and 1, wherein said means for selectively placing comprises a pair of shafts supporting said tractor feeder and a pair of slots in said housing, the shafts being disposed in said pair of slots, the slots being elongated along two respective directions, the shafts being movable along the slots whereby said tractor feeder is adjustable between the first and the second positions.

* * * * *